United States Patent [19]

Barbulla

[11] Patent Number: 4,793,013

[45] Date of Patent: Dec. 27, 1988

[54] WATER MATTRESS BAG, AND A METHOD FOR PRODUCING THE SAME

[76] Inventor: Winfried P. Barbulla, Bregneveien 22, N-1825 Tomter, Norway

[21] Appl. No.: 32,583

[22] Filed: Apr. 1, 1987

[30] Foreign Application Priority Data

Apr. 4, 1986 [NO] Norway ..... 861319
Sep. 29, 1986 [NO] Norway ..... 863868

[51] Int. Cl.[4] ..... A47C 27/08

[52] U.S. Cl. ..... 5/451; 5/450; 156/217; 156/308.4

[58] Field of Search ..... 5/451, 450, 455, 422, 5/400; 156/217, 308.4

[56] References Cited

U.S. PATENT DOCUMENTS

| | | | |
|---|---|---|---|
| Re. 32,420 | 9/1987 | Autry et al. | 5/451 |
| 3,789,442 | 2/1974 | Tobinick | 5/451 |
| 3,815,165 | 6/1974 | Tobinick et al. | 5/451 |
| 4,186,455 | 2/1980 | Fox et al. | 5/451 |
| 4,187,566 | 2/1980 | Peterson | 5/451 |
| 4,354,289 | 10/1982 | Richards et al. | 5/451 |

*Primary Examiner*—Alexander Grosz
*Attorney, Agent, or Firm*—Browdy & Neimark

[57] ABSTRACT

A water mattress bag (1) of a watertight resilient material with tensile strength is provided with a valve for filling/draining water and is intended for use together with a main mattress member (3) of a resilient, flexible foamed plastic or the like, which is provided with a recess (4) in its upper face extending over a substantial portion of its length (L) and width (B). The bottom (1*a*) of the bag (1) is shaped with a bulge (1*a'*) for cooperation with recess (4), and the top (1*d*) of the bag (1) has a length and width approximately equal to the length (L) and width (B).

Water mattress (10) comprises the above mentioned components and a flexible sheet (15) on top of water mattress bag (1) and a mattress cover (16). Water mattress bag (1) is partly filled with water and extends outwards to the lateral edges (3*a*) of main mattress member (3) and covers the flat edges (3*b*) of main mattress member (3) around recess (4). Sheet (15) is a weight distributing sheet and shaped complementary with the opening of recess (4), and has a thickness (a) causing the top (15*a*) of weight distributing sheet (15) to project higher than said flat edges (3*b*) of main mattress member (3) in a non-loaded state. Mattress cover (16) is stretched around main mattress member (3) with components (1,15) to provide a bias/increase of pressure of the water in water mattress bag (1) in an un-loaded state of the mattress (10).

11 Claims, 4 Drawing Sheets

Figure 1:
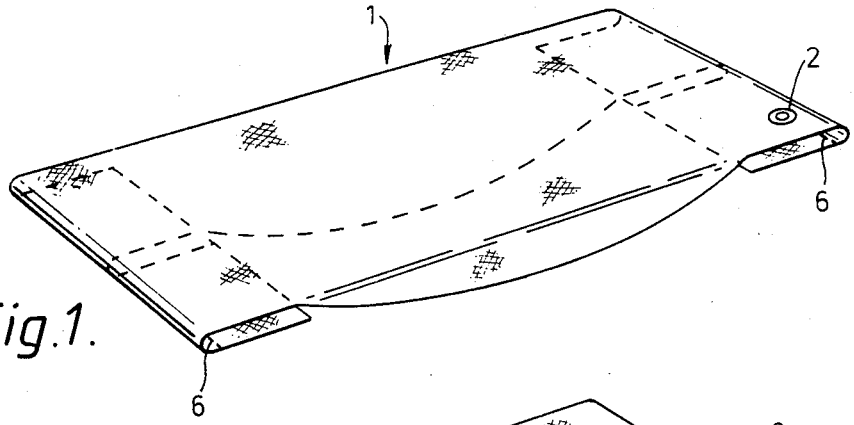

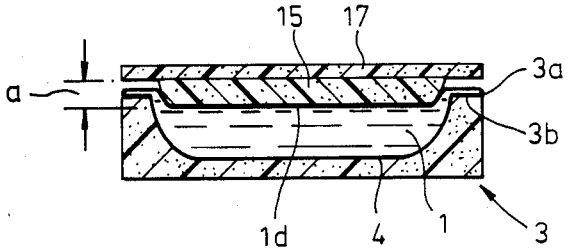
Fig. 9.
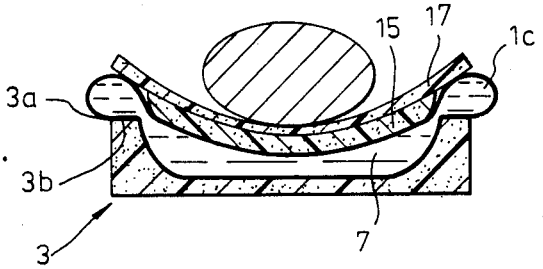
Fig.10.
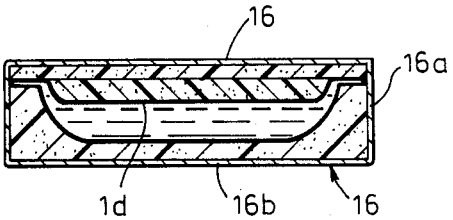
Fig.11.
Fig.12.
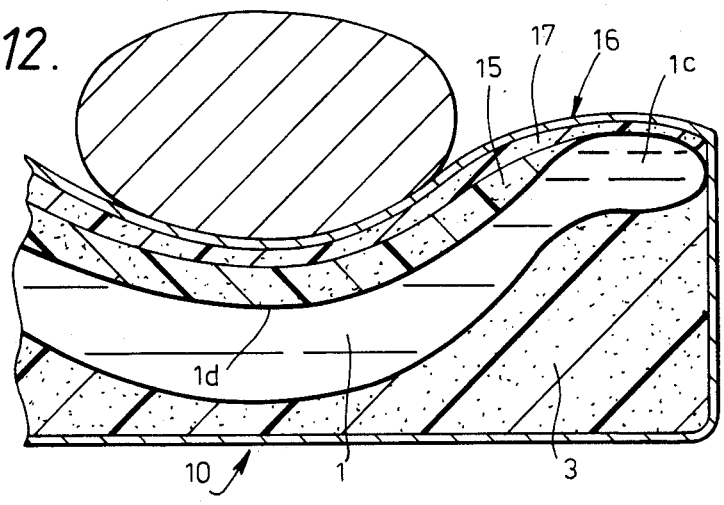

WATER MATTRESS BAG, AND A METHOD FOR PRODUCING THE SAME

The present invention relates to a water mattress bag for use with a main mattress member of the kind as defined in the introductory part of the following independent claim 1. Furthermore, the invention relates to a method for producing such a water mattress bag. The invention also relates to a water mattress as defined in the introductory part of the following claim 8.

Conventional water beds comprise a sturdy bottom plate with frame members provided on a weight distributing base. Said frame members enclose a water bag provided on said bottom plate and consisting of a flexible material with tensile strength, and containing approximately 400–500 liters of water for each person unit, resulting in a water depth of approximately 20–24 cm in a bed area of normal size. Said frame members which must necessarily project above the level of said water bag do not provide for comfortable sitting on the edge of the bed, and the bearing capacity of said water bag is highly reduced adjacent the inside of said frame. The large volume of water will result in disadvantages, e.g. high weight, great hazard of water damages in case of a leakage, and high operation costs for heating water and supplying antialgal agents to prevent growth. In order to prevent water leakages in such water beds a safety sheet is provided between said water bag and the bottom and frame memebers. Due to the fact that said safety sheet is provided in direct contact with the water bag there is a hazard of double puncture, i.e. that a pointed or sharp object can puncture both water bag and safety sheet at the same place with a resulting leakage of water into the room.

In further developed water bed mattresses the above disadvantages of conventional water beds were partly eliminated, e.g. as disclosed in U.S. Pat. Nos. 3,689,949 and 3,456,270. These specifications show a mattress made of foamed plastic or another suitable material shaped with a recess in the surface that is adapted to the dorsal profile of a person in a lying position. A bag or the like of a water tight flexible material filled with water is placed on top of said mattress in said recess. In this manner a reduction of the weight of the water mattress is achieved by utilizing a light weight mattress material, e.g. foamed plastic, as well as reduced use of water the volume of water substantially being present in a recess that is adapted to the human body. In case of pin-point load the soft material of said foamed plastic mattress will, furthermore, subdue or cause an elastic contact with the harder support in the bottom of the bed or with any other base on which said water bed mattress is provided. It is, furthermore, known to provide a cover on top of such a water bed mattress, said cover being fastened to the side faces of said foamed plastic mattress, e.g. by the aid of hook and loop type fasteners, such as the one sold under the trademark of Velco.

The last mentioned water bed mattresses are intended for being provided in ordinary beds comprising a bottom and a frame. The water bag itself is, thus, shaped with top and bottom sides having dimensions that ar larger than those of the frame of the bed, i.e. larger than the dimensions of the frame length and width, so that the bottom face and the top face of said bag adapt to the surface of said foamed plastic mattress with its recess and to the shape of the user's body resulting in a pressure of said water bag directed outwards toward the insides of said frame.

It is an object of the present invention to provide a water mattress bag for use with a main mattress member consisting of foamed plastic or another suitable material and shaped with a recess in its surface, as mentioned above, with said water mattress bag shaped so as to maintain its peripheral shape intact when it is filled and placed on a main mattress member with a recess, i.e. so as not to need any lateral support, and that said peripheral shape is also maintained when said water mattress bag is loaded by a person sitting or lying down on it. According to the invention this is achieved by the features appearing from the characterizing part of the following independent claim 1 and the following dependent claims.

Another object of the invention is to provide a method for producing a water mattress bag of the kind mentioned above so as to achieve simple and inexpensive production. According to the invention this is achieved by the features appearing from the characterizing part of the following method claims.

Water beds gradually developed from being a medical aid used in hospitals and institutions to a very popular piece of sleeping furniture which has general use.

Water beds of the original design contain much water causing a great load of weight on bed and floor which brought about special bed structures with a weight distributing support on the base, i.e. The floor.

In order to produce a water bed mattress for use in ordinary beds and without use of a weight distributing support it is necessary to reduce the volume of water to such a degree that the water bed mattress may be supported by conventional bed structures and without any further auxiliary means.

Such a reduction of the weight of the water mattress is achieved by technology as mentioned above, which is also disclosed in GB-PS No. 1 140 767 describing a resilient main mattress member with a recess curved in the longitudinal and transversal directions in its upper surface, in which recess a partly filled water bag is placed.

A resilient sheet provided on top of the water bag, and mainly intended as a thermal insulation between the person lying on said water mattress and the water in said water bag, is shown in U.S. Pat. No. 4,186,455 and GB-PS No. 1 559 264. The two last mentioned specifications, however, do not show said resilient main mattress member with said curved recess in the upper surface and, thus, comprise a water mattress bag filled with a larger volume of water than water mattresses of the kind mentioned above.

Similar water/weight reducing mattress structures are, among others, known from the American mattress model "Somma", foom the Ulfert model "Royal", and, among others, from the Norwegian patent application Nos. 845056 and 861319. These structures are based on somewhat differing principles, however, it is a common characteristic that they require larger volumes of water than the present invention without offering better lying comfort than that achieved by the water mattress according to the present invention.

It is a further object of the present invention to achieve a water bed mattress which contains very little water and which only requires approximately 50–140 liters per person unit, depending on the mattress dimensions, and which shows subdued waves without any use of a built-in wave-calming means, as well as maintaining its load bearing capacity even in case of minimum external dimensions, e.g. with a width of 75 cm of the mattress. Furthermore, such a water mattress has dimensions and the appearance of an ordinary mattress, and it is inexpensive in production.

According to the present invention this is achieved by the characterizing features stated in the following claim 8 and in the following dependent claims 9–13.

Figure 2:
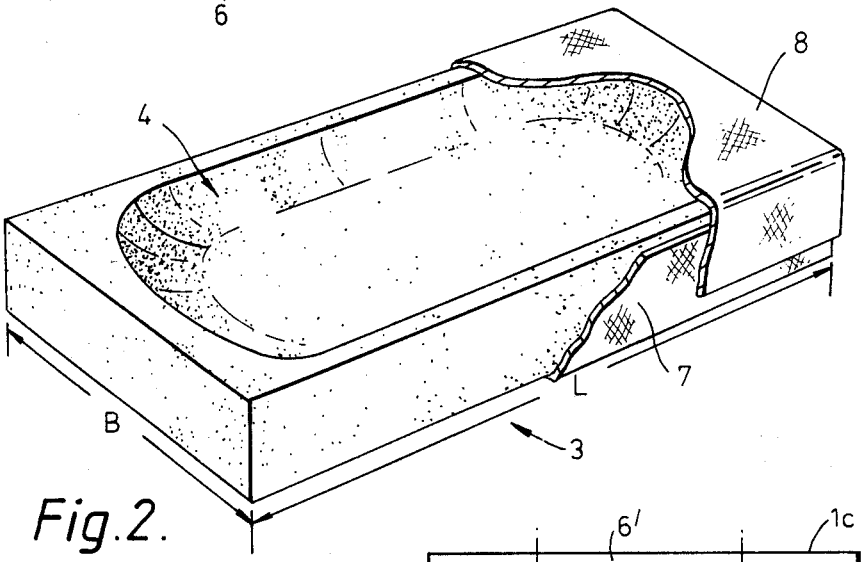
Figure 3:
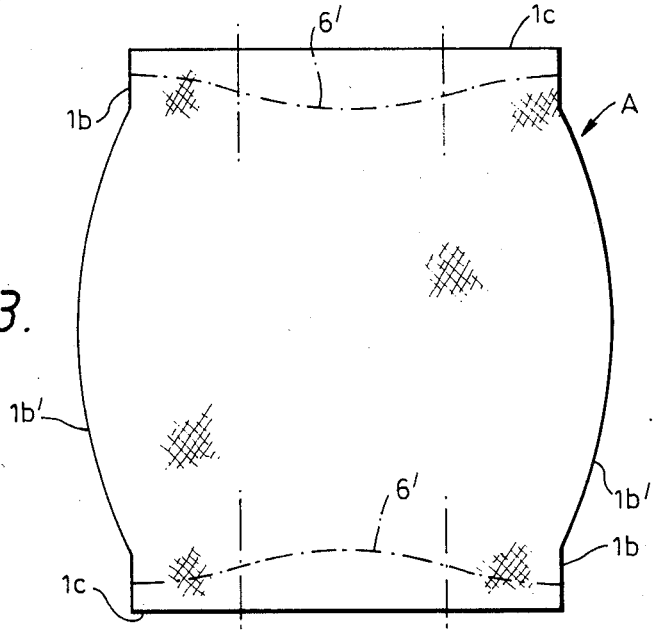
Figure 4:
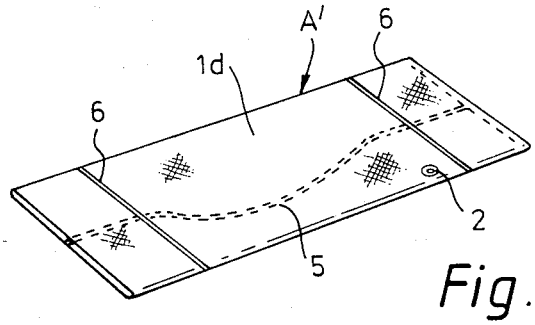
Figure 5:
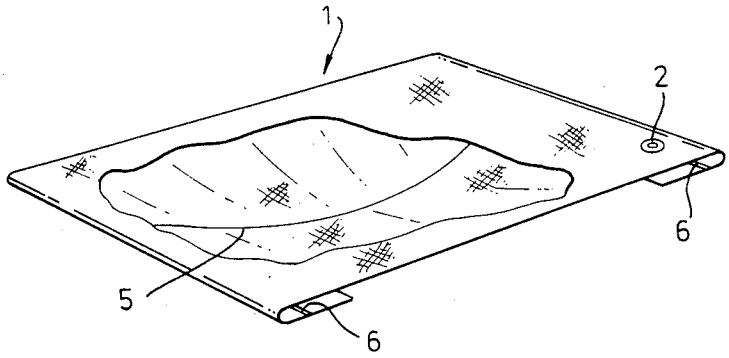
Figure 6:
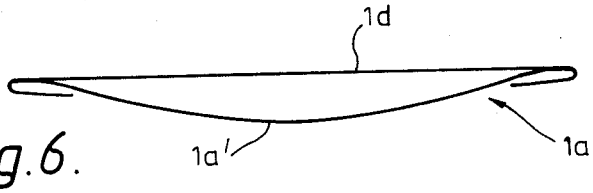
Figure 7:
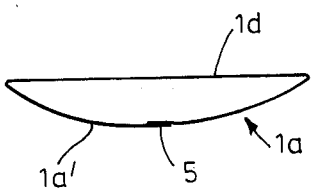
Figure 8:
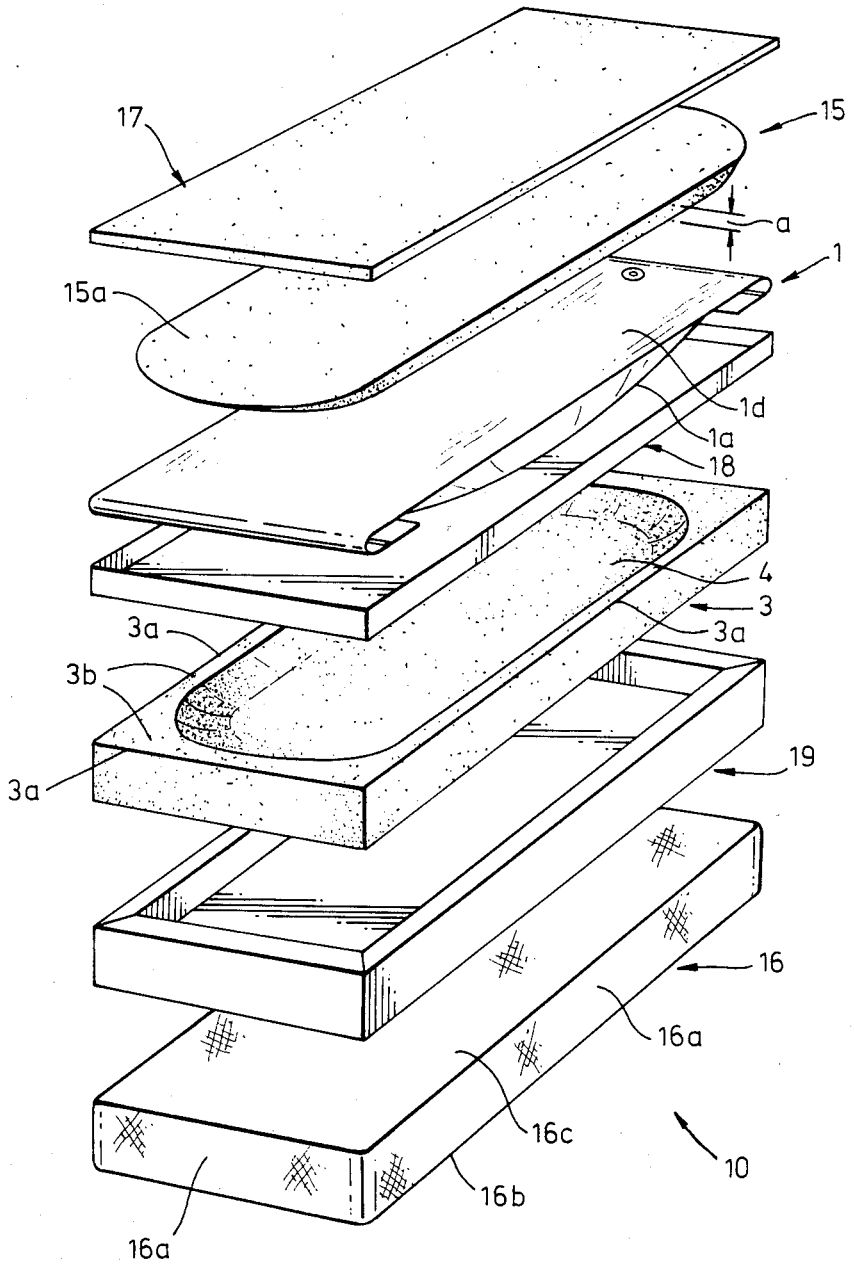

Embodiments of the invention are disclosed in more detail below with reference to the drawing, where FIGS. 1 and 2 show views in perspective of a water mattress bag in a filled state and a foamed plastic mattress with a recess and with a covering sheet and a safety sheet partly removed to facilitate understanding, respectively, FIG. 3 shows a blank of a water mattress bag in a flat state, FIG. 4 shows the bag blank welding completed with longitudinal and transversal welded seams, FIG. 5 shows the same blank with folded end portions, FIGS. 6 and 7 show mattress bag with folded end portions in a longitudinal section, and a cross section, respectively, with the shape said bag will have when filled with water and placed in the associated main mattress member, FIG. 8 shows the components of a water mattress in an exploded view in perspective, FIG. 9 is a cross sectional view of the water mattress in an unloaded state, and without a mattress cover, FIG. 10 shows the same mattress in a loaded state, FIG. 11 shows the same cross sectional view as FIG. 9, but with a stretched mattress cover, and FIG. 12 shows a water mattress with a stretched cover according to FIG. 11, but in a loaded state.

FIG. 1 shows a water mattress bag 1 of a resilient material having tensile strength and provided with a valve 2 for filling up, and draining off water, respectively. Said water mattress bag has a bottom face 1*a* provided with a bulge 1*a'* and a top face 1*d* which is plane and has a length and a width corresponding to length L and width B of a main mattress member 3, as shown in FIG. 2, e g. made of resilient flexible foamed plastic. The main mattress 3 has recess which extends over a substantial part of its surface in the longitudinal and transversal directions. Said water mattress bag 1 is, thus, intended for lying—in a liquid filled state—on the surface of said main mattress member 3 and to rest with its bulge 1*a'* in said recess 4 of the mattress surface. The water bed mattress thus formed is preferably provided with a safety sheet 7 of watertight material which extends beneath the bottom of said main mattress member 3 and alongside its lateral edges, and acts as a leakage barrier, as shown in FIGS. 1 and 2. On top of water mattress bag 1 a cover 8 is preferably provided and extends down over the lateral edges of the main mattress member 3 outside said safety sheet 7, and may be fastened to the latter, e.g. by hook and loop type fasteners, such as the one sold under the trademark of Velcro or in any other desirable manner.

By use of a foamed plastic mattress having a thickness of approximately 17 cm and being provided with a cavity forming said recess 4, a basin which can receive a water mattress bag 1 only containing approximately 150 liters may be achieved by suitable dimensioning of the length, width, and depth of said recess 4. This constitutes an essential reduction of. The volume of water as compared with previously known water bed mattresses. Due to the design of the water mattress bag 1 the main portion of the volume of water will be in recess 4 and with a water depth of approximately 12 cm, provided that recess 4 is approximately 12 cm deep. This water depth is sufficient to carry a lying person without said person contacting the bottom of recess 4. In case of a pin-point load, i.e. when a person, e.g. sits on water mattress bag 1, the load will be transmitted in a subdued manner to the support of main mattress member 3 via the bottom of recess 4 which is approximately 5 cm thick.

Water mattress bag 1 preferably consists of a blank A of a watertight, resilient foil/sheet material showing tensile strength, as shown in FIG. 3, with two pairs of opposite edges 1*b*,1*b*, and 1*c*,1*c*. One pair of lateral edges 1*b*,1*b* is provided with curved or tongue shaped projections 1*b'*,1*b'* extending along a substantial portion, of the lateral edges 1*b*,1*b* and ending at a distance from the said transverse edges 1*c*,1*c*. When water mattress bag 1 is produced, said lateral edges 1*b*,1*b* with projections 1*b'*,1*b'* are placed in a level state one on top of the other and are joined, e.g. by lap welding with a longitudinal welded seam 5 being formed. In this manner a sleeve A' is shaped from blank A with its openings limited by the second pair of lateral edges 1*c*,1*c*. The end openings of sleeve A' are then closed by transverse welded seams 6, 6 in the end portions of sleeve A' that were placed in a flat state. When said end portions are placed in a flat state it is necessary to ensure that said first longitudinal lateral edge joined/welded seam 5 will cross said transverse welded seams 6, 6 in their central portion. The projection or bulge 1*a'* formed due to the curved projections 1*b'*,1*b'* of the lateral edges 1*b*, 1*b* will, thus, be oriented under water mattress bag 1 and form its bottom 1*a*, whereas the opposite portion of closed sleeve A' will form the top face 1*d* of said water mattress bag which has a rectangular shape corresponding to the contour of main mattress member 3. In order to improve the longitudinal bulge of the bottom 1*a* of water mattress bag 1 said bottom and top faces may be mutually displaced as to their longitudinal direction by the aid of said transverse welded seams 6,6.

As shown in FIG. 4, said transverse welded seams 6, 6 are placed at a distance from the ends of sleeve A' and at a mutual distance that is, preferably, a little larger than length L of main mattress member 3. Thus, the end portions of water mattress bag 1 with said transverse welded seams 6, 6 may be folded in under said water mattress bag when it is placed on top of main mattress member 3 with said transverse welded seams 6, 6 in the folded portions. Sudden increases of pressure inside water mattress bag 1, e.g. when a person lets himself fall onto the water bed mattress, will then be subdued at the fold, and transverse welded seams 6, 6 will receive a reduced load from the pressure trying to force the lap seams apart.

FIGS. 6 and 7 show a longitudinal section, and a cross section, respectively, of water mattress bag 1 having a plane top face 1*d* and an underside with a bulge 1*a'*. In FIG. 6 the end portions of said water mattress bag are shown in a folded state.

The disclosed water mattress bag 1 has a very simple structure and may, thus, be produced in a simple and inexpensive manner since there are only three simple lap-welded seams 5, 6, 6, to be made, i.e. said water mattress bag is only welded in three places.

This is done by folding said blank A so as to bring its opposed lateral edges 1*b*, 1*b* with their curved projections 1b',1b' in contact and by lap-welding to obtain the resulting lap-welded seam 5. The end portions of sleeve A' formed in this manner are then placed in a flat manner with welded seam 5 approximately in the center of the formed face. Said end portions of sleeve A' are then closed by lap-welding 6, 6 across said end portions at a distance from their ends that are limited by said opposed lateral edges 1c, 1c of the blank.

As will appear from the above described water mattress bag, there are no expensive and complicated corner designs with associated leakage problems. According to the method for producing said water mattress bag the top face and underside of the bag lie flat in contact in the joining areas, and they can be joined by the aid of simple lap-welding.

In stead of the above mentioned lap-welding, obviously, any suitable method of joining the lateral edges 1b,1b of bag blank A and of closing the obtained sleeve A' at its end portions may be used.

The above mentioned mutual displacement of the bottom and top faces 1a, 1d of said water mattress bag 1 in order to obtain an improved longitudinal bulge of the bottom is achieved by displacing the end portions of bottom side 1a towards each other, whereas top face 1d is left as it is. Then the pairs of top faces 1d and bottom faces 1a are joined, e.g. by said lap-welding to form lap welded seams 6, 6. Thus, the bottom face 1a will become longer than top face 1d.

In order to ensure that a correct displacement is achieved in connection with welding said transversal welded seams 6, 6 the blank A may, in advance, be provided with marking lines 6' which lines extend in a wavelike shape across the end portion of blank A. Said wavelike shape is made so as to form the largest distance between marking lines at each of the longitudinal lateral edges 1b, 1b of blank A and the shortest distance at the longitudinal center of blank A. When blank A has been folded and welded along its longitudinal edges 1b, 1b those portions of marking lines 6' extending on top face 1d and bottom face 1a, respectively, are aligned by displacement of bottom face 1a before the lap weld is made which will, thus receive a curved shape.

In order to reduce the load on the end portions of the lap welded seam in case of a sudden increase of pressure inside water mattress bag 1, the end portions of transverse welded seams 6 are curved toward each other to change softly into the longitudinal sides of water mattress bag 1.

For the production of a water bed mattress 10 according to the present invention a main mattress member 3 of foamed plastic, cold setting foam, latex, foamed rubber, polystyrene, or the like is used. In its upper surface a recess 4, a so called lying cavity is cut or moulded, said cavity being concavely curved both in the longitudinal and the transversal direction, adapted to the contours of a lying person in such a manner that the concave longitudinal curve is less curved under the leg/foot portion and more curved under the head end. In said recess 4 a water mattress bag 1 of the above mentioned kind which is adapted to the dimensions of said recess is placed. Said water mattress bag has a bottom 1a the shape of which is adapted to recess 4, and a flat top 1d. Water mattress bag 1 is partly filled with water and extends to the lateral edges 3a of main mattress body 3 and, thus, covers the flat edges 3b of main mattress member 3 around recess 4, the top 1d of water mattress bag essentially being lower than said flat edges 3b.

If recess 4 is cut out of main mattress member 3, a correspondingly shaped piece of material is left, which fits accurately in said recess. By cutting a top piece with a thickness of, e.g. 4 cm a resilient sheet 15 will result with a contour complementary to the recess 4 opening. This sheet may be used as a weight distributing sheet 15 on top of water mattress bag 1. Obviously, any desirable sheet of a similar material and with a corresponding contour may be used for a weight distributing sheet.

The thickness of weight distributing sheet 15 is such that its upper side 15a in an unloaded state will at least project to the flat edges 3b of main mattress member 3, but preferably somewhat higher. A mattress cover 16 is stretched around main mattress member 3 with the above mentioned components 1 and 15 to keep said components in place, and top provide a bias/increase of pressure in the water in water mattress bag 1 when water mattress 10 is in an unloaded state. Between said mattress cover 16 and weight distributing sheet 15 a resilient sheet 17 is, preferably, arranged to extend to the lateral edges 3a of main mattress member 3, said sheet 17 being softer than said weight distributing sheet 15.

With such a build-up of the water mattress according to the invention the water inside said water mattress bag 1 is kept under a moderate hydrostatic pressure by the aid of said stretched mattress cover 16.

The material of said water mattress bag is thus subjected to a tensioning load so that part of the resiliency of the material is used up. Due to said bias compression of the water mattress bag will be reduced resulting in less sag when there is a further load. This means that said water mattress can tolerate a greater load without sagging through,—i.e. letting the loading body reach the bottom of recess 4—with resulting compression of the main mattress member 3 than is the case with water mattresses without any bias in the water mattress bag. When said water mattress has a load put on it, said weight distributing sheet will distribute said load to a larger area of the water mattress bag, especially in case of a pin-point load, and sagging is thus reduced. On top of weight distributing sheet 15 a softer resilient sheet 17, e. g. of foamed plastic, may be provided to extend outwards to the lateral edges 3a of main mattress member 3, in order to provide a softer bed to lie on. Said softer sheet 17 may, if desired, be combined with weight distributing sheet 15 to one member. Such a member may, if desired, be produced from foamed plastic materials of different degrees of hardness from the underside to the top. The water mattress comprising main mattress member 3, water mattress bag 1, weight distributing sheet 15, and said softer sheet 17 on top, and with the last mentioned sheets 15 and 17 projecting slightly above the flat edges 3b of main mattress member 3 around recess 4, as mentioned, is held together by a stretched mattress cover 16, which is preferably put around said components by the aid of a mattress covering machine in a manner known per se. This means that said main mattress member with the mentioned further components is slightly compressed so as to have a slightly smaller width and length. The mattress cover can now be pulled otto said main mattress member, the compressing means is removed, and mattress cover 16 is now stretched around the entire main mattress member with components as mentioned.

Said stretched mattress cover 16 will exert a moderate pressure on the softer upper sheet 17 which will, in turn, press down onto weight distributing sheet 15, and the latter will press down onto the top face 1*d* of water mattress bag 1. In this manner said bias of water mattress bag 1 is achieved with the mentioned partial consumption of the resiliency of the water mattress bag material.

When said water mattress is loaded by a lying person the weight of said person's body will be distributed by weight distributing sheet 15 any local sag into the water being transmitted to a larger area. Due to the bearing capacity of said larger area or surface any sag is reduced and requires a smaller depth of water beneath said weight distributing sheet 15, without causing said water mattress to appear rigid or hard, since weight distributing sheet 15 is flexible and will adapt to the movements of both body and water.

In case of such a load the water in water mattress bag 1 will tend to "overflow" the edge of recess 4 and, thus, form a sausage-like swelling 1*c*—FIG. 10—on top of the flat edges 3*b* of the main mattress member 3 around recess 4. This means that water is forced into the marginal zones of water mattress bag 1 where there is no water in a non-loaded water mattress.

Such an "overflow" is reduced because mattress cover 16 of mattress 10 is least resilient in the upward direction of mattress 10. A water mattress having such a stretched mattress cover 16 will have higher bearing capacity than one without such a mattress cover, because the lateral displacement of water into the marginal zone of water mattress bag 1, which zone may also be called expansion portion, will compress the uppermost soft sheet 17 in its peripheral edges, as well as part of the foamed material in main mattress member 3 surrounding water mattress bag 1. This cooperation between components and materials of the water mattress will cause a synergy effect provoking a "springy" effect of the water, since the water will always ee forced back with a higher force due to said bias than if it flows back of its own gravity alone.

The above mentioned features are illustrated in FIGS. 9–12 in the drawing. FIG. 9 shows said main mattress member 3 with a partly filled water mattress bag 1 in recess 44,and with weight distributing sheet 15 and the softer sheet 17 on top in a non-loaded state without any mattress cover 16. It will clearly appear that weight distributing sheet 15 lies on the top 1*d* of water mattress bag 1 and has a thickness a causing weight distributing sheet 15 to project over the flat edges 3*b* of main mattress member 3 around recess 4.

If the water mattress as shown in FIG. 9, without any stretched mattress cover, is loaded, said weight distributing sheet 15, and the softer upper sheet 17 will be pressed down by the body of a lying person, as shown in FIG. 10, toward water mattress bag 1 which will be compressed in its central longitudinal area water being displaced to the marginal zones of said water mattress bag which will, thus, form a "sausage like" swelling 1*c* that may also, as mentioned above, be called the expansion portion of said bag.

By providing a stretched mattress cover 16 outside the components of the water mattress as shown in FIG. 9, an increase of the hydrostatic pressure inside water mattress bag 1 is chieved as mentioned above and shown in FIG. 11, due to the fact that mattress cover 16 will force weight distributing sheet 15 and the softer sheet 17 on top towards the flat edges of water mattress bag 1, and main mattress member 3, respectively. Since said components, and the main mattress member 3 itself consist of resilient springy materials, said components will be slightly compressed by mattress cover 16 causing said increase of the hydrostatic pressure in water mattress bag 1. Said increase of the hydrostatic pressure will cause reduced sag in case of a load as compared to what is shown in FIG. 10, because said increased hydoostatic pressure must be overcome by part of the load before sagging or compression occurs. Simultaneously with said compression of water mattress bag 1 water will be displaced to the marginal areas of water mattress bag 1, where the swelling of the expansion portion 1*c* of said bag is partly subdued because of the stretched mattress- cover 16. Also, the formed swelling will partly exert a downwards directed force onto the flat edges 3*b* of main mattress member 3, which will yield in a springy manner, as shown in FIG. 12, and will exert a counter pressure onto water mattress bag 1 contributing to said reduction of sagging.

A water mattress has thus been achieved which has a good bearing capacity in relation to the used volume of water in water mattress bag 1. Said volume of water in a water mattress having a width of 75 cm may be as small as approximately 50 liters. This means that the bearing capacity of a water mattress acording to the invention as disclosed above is sufficient even though the used volume of water in said water mattress bag is less than the volume of water which the user's weight would displace.

When water is maintained under an increased hydrostatic pressure, as mentioned above, it has no space for developing wave crests, and there will thus be no so called "wave ripples" when the mattress is used.

Weight distributing sheet 15 will settle as a further wave subduing means "on top of the water", i.e. on top of water mattress bag 1 and will also subdue any ripples.

Thus, a water mattress is provided which has a particularly low ripple forming effect without having any special components introduced into the interior of water mattress bag 1 to calm any possible movement of water that might create ripples.

The above disclosed water mattress is, in addition to the conventional safety sheet 18 against leakage of water which is always provided in direct contact with bottom 1*a* of water mattress bag 1, provided with a further safety sheet 19 to enclose the sides and bottom of main mattress member 3. In case the conventional safety sheet 18 should be punctured leaking water will be absorbed by main mattress member 3 and held back by further safety sheet 19. In this manner a larger volume is, thus, encased and will be able to absorb the considerably smaller volume of water in water mattress bag 1 in case of a "total wreckage".

In order to secure that mattress cover 16 can adjust said increased hydrostatic pressure it may, e.g. be provided with side walls 16*a* of a material of high tensile strength, and if desired, bottom 16*b* and/or top 16*c* may be made from a material with tensile strength. Combinations of a resilient material and a material with tensile strength are possible as well in order to ensure desired effects when water mattress 10 is loaded. If a material with tensile strength is, e.g. used in the side walls 16*a* of said mattress cover 16, they will highly contribute to reduce said sausage-like swelling 1*c* of the marginal areas of water mattress bag 1. If a material with tensile strength is used in the entire mattress cover, this will contribute to more compression of main mattress member 3, and weight distributing sheet 15 as well as the softer sheet 17 when loaded, because water in said water mattress bag 1 will not be able to flow to expansion portion 1c to the same degree, thus, causing a more firm surface to lie on.

I claim:

1. A water mattress bag of a resilient material and provided with a valve (2) for filling/draining water, for use with a main mattress member (3) of a resilient, flexible foamed plastic or some other similar material having a recess in its surface (4) extending over a substantial portion of the length (L) and width (B) of said surface, the bottom side (1a) of said water mattress bag (1) being shaped with a bulge (1a') for cooperation with said recess (4), and the top side (1d) of said water mattress bag (1) having a length (L) and width (B), said water mattress bag (a) consisting of a blank (A) of a watertight resilient foil/sheet material with tensile strength with two pairs of opposed lateral edges (1b,1b) and (1c,1c), one pair of lateral edges (1b,1b) having curved or tongue shaped projections (1b,'1b'), with said lateral edges with curved projections joined together along a longitudinal seam (5) and forming a sleeve (A') the openings of which are limited by a second pair of lateral edges (1c,1c) and closed by transverse welded seams in superimposed sleeve walls flattened against one another with said longitudinal seam (5) crossing the central portions of said transverse welded seam (6,6), said transverse welded seams (6) being provided at a distance from the ends of sleeve (A') having lateral edges (1c,1c).

2. A water mattress bag as defined in claim 1, characterized in that said transverse welded seams (6,6) are provided between the ends of said projections (1b',1b') and the second pair of lateral edges (1c,1c).

3. A water mattress bag as defined in claim 1, characterized in that said transverse welded seams (6) are curved towards each other at their end portions to create a soft transition into the longitudinal sides of said water mattress bag.

4. A water mattress bag as defined in claim 1, characterized in that the distance between said transverse welded seams (6,6) is approximately equal to the length (7) of main mattress member (3), for folding the end portions of said water mattress bag (1) with said transverse welded seams (6,6) under said water mattress bag in a position for use on main mattress member (3).

5. A water mattress, comprising a flexible main mattress member (3) with a recess (4) curved in the transverse and longitudinal directions in its top face with flat edges (3b) about said recess, a water mattress bag (1) having a bottom (1a) with a shape that conforms to said recess (4), and a flat top (1d), said water mattress bag resting on said main mattress member and partly within said recess, a flexible sheet (15) on top of said water mattress bag (1) and a mattress cover (16), said water mattress bag (1) being partly filled with water and extending to the lateral edges (3a) of main mattress member (3) thus covering the flat edges (3b) of main mattress member (3) around recess (4), said sheet (15) being a weight distributing sheet for distributing weight when loaded, and being shaped complementary with the (4), and having a thickness (a) casing the top (15a) of said weight distributing sheet (15) to project at least up to the flat edges (3b) of main mattress member (3) in a non-loaded state, said mattress cover (16) being stretched around main mattress member (3) with said components (1, 15) to keep them in place, and to cause a bias/increase of pressure in the water inside water mattress bag (1) in a non-loaded state of said water mattress (10), said water mattress bag (1) consisting of a blank (A) of a watertight resilient foil/sheet material with tensile strength with two pairs of opposed lateral edges (1b,1b) and (1c,1c), one pair of lateral edges (1b,1b) having curved or tongue shaped projections (1b',1b'), with said lateral edges with curved projections joined together along a longitudinal seam (5) and forming a sleeve (A') the openings of which are limited by a second pair of lateral edges (1c,1c) and closed by transverse welded seams in superimposed sleeve walls flattened against one another with said longitudinal seam (5) crossing the central portions of said transverse welded seam (6,6), said transverse welded seams (6) being provided at a distance from the ends of sleeve (A') having lateral edges (1c,1c).

6. A water mattress as defined in claim 5, characterized in that a flexible sheet (17) extending outwards to the lateral edges (3a) of main mattress member (3) and being softer than said weight distributing sheet (15) is provided between said mattress cover (16) and said weight distributing sheet (15).

7. A water mattress as defined in claim 5 characterized in that the side walls (16a) of said mattress cover (16) have tensile strength.

8. A water mattress as defined in claim 7 characterized in that the bottom (16b) of said mattress cover (16) has also tensile strength.

9. A water mattress as defined in claim 7, characterized in that the top (16c) of said mattress cover (16) has tensile strength.

10. A water mattress as defined in claim 6, characterized in that said weight distributing sheet (15) and said softer, flexible sheet (17) are in one piece.

11. A water mattress bag of generally tubular shape (A') for use with a main mattress member having a recess in its surface extending over a substantial portion of the length and width thereof, the bottom side of said tubular water mattress bag being shaped with a bulge conforming with the recess of the main mattress member, and the top side of water mattress bag having a length and width approximately equal to the length and width of the main mattress member, said water mattress bag being formed of a blank (A) of a water tight resilient foil-sheet material having a pair of opposed transverse edges (1c) and a pair of opposed longitudinally extending edges (1b), said longitudinally extending edges being shaped with curved shaped projections (1b') joined together along a longitudinal seam (5) to provide said bulge for cooperation with the recess of the main mattress member, the tubular water mattress bag being flattened to define a top side (1d) and a bulged bottom side (1a') with end portions in facing contact, and said end portions being joined by lap-welded seams (6) at a distance spaced from the transverse edges (1c), said blank being formed into said water mattress bag by mutually displacing the top side thereof from the bottom side before said transverse lap welding seams are made in order to form a bottom that is longer than the top to achieve said longitudinal bulge of the bottom.

* * * * *